United States Patent [19]

Ferreira-Godinho

[11] Patent Number: 4,600,329

[45] Date of Patent: Jul. 15, 1986

[54] FOLDER FOR PAPER SHEETS OR THE LIKE

[76] Inventor: Manuel Ferreira-Godinho, Bergiusweg 10, D-3250 Hameln 1, Fed. Rep. of Germany

[21] Appl. No.: 670,633

[22] Filed: Nov. 13, 1984

[30] Foreign Application Priority Data

Nov. 14, 1983 [DE] Fed. Rep. of Germany ..... 3341175
May 18, 1984 [DE] Fed. Rep. of Germany ..... 3418456
Jul. 18, 1984 [DE] Fed. Rep. of Germany ..... 3426509
Jul. 27, 1984 [DE] Fed. Rep. of Germany ..... 3427855

[51] Int. Cl.[4] ..... B42F 13/00; B42F 15/00; B42D 3/04; B42D 17/00

[52] U.S. Cl. ..... 402/74; 281/34; 281/46; 40/359

[58] Field of Search ..... 402/4, 42, 74–78, 402/500–503; 281/15 A, 25 A, 25 R, 26, 29, 45, 46, 34–36; 312/183, 184, 189; 40/359, 530

[56] References Cited

U.S. PATENT DOCUMENTS 1,354,354 9/1920 Tolano ..... 281/34
3,936,201 12/1976 Kenney et al. ..... 312/184
4,053,057 10/1977 Snowden ..... 40/359
4,395,058 7/1983 Terrell ..... 281/46

*Primary Examiner*—Paul A. Bell
*Assistant Examiner*—Paul M. Heyrana, Sr.
*Attorney, Agent, or Firm*—Andrus, Sceales, Starke & Sawall

[57] ABSTRACT

A folder for paper sheets comprising a carrier body (20) is provided, said folder consisting of a bottom (21), a back (22) optionally including a handling hole (36), and a cover (23), said parts being joined to each other by means of permanently foldable creases (26, 27). The bottom (21) is adapted to be provided with a line-up mechanism including U-clamps. At least those regions of bottom (21) and cover (23) which adjoin the back (22) have a greater width than the remaining areas of bottom and cover, so that equal-sized symmetrical lugs (28) are formed which are integral with the carrier body (20). Such a folder may selectively be set up either in upright position, in horizontal position or suspended in a suspension file system.

20 Claims, 23 Drawing Figures

FOLDER FOR PAPER SHEETS OR THE LIKE

BACKGROUND OF THE INVENTION

The invention is directed to folders for paper sheets or the like, comprising a carrier body made especially of plastics or metal and consisting of a bottom, a back optionally formed with a handling hole, and a cover, said parts being joined to each other by means of permanently foldable creases, the bottom being adapted to be provided with a line-up mechanism including U-clamps.

Such a folder has been known, for instance, from DE-A No. 2,303,218, in which the folder is made of plastics material but for reasons of greater strength includes regions of increased material thickness which constitute diagonal stiffenings. The cover is formed with slots having unilaterally protruding rigid detents which, when the folder is upright, are capable of engaging behind the U-clamps of the line-up mechanism so as to prevent opening of the folder while in the upright position. Such a folder is not suitable, however, for a suspension file system, so that its uses are limited.

For practical purposes it is, however, desirable to make use of a folder for paper sheets or other documents in a highly versatile manner without any problems when filing such folders. It is furthermore undesirable to be limited to a certain filing system so that, for instance, filing in a suspension file system is impossible such that the space-saving accommodation in cabinets or desks cannot be utilized or binders have to be used instead of folders.

It is therefore the object of the instant invention to provide a folder of the above-specified kind, which is easy to manufacture and particularly versatile in use so that it may be filed selectively in horizontal or upright or suspended position.

SUMMARY OF THE INVENTION

The solution of the above-specified object in accordance with the invention resides in that at least the regions of bottom and cover which adjoin the back, and optionally the back itself, have a greater width on either side than the remaining areas of bottom and cover, and that said wider regions define substantially rectangular, symmetrical lugs of equal size on either side, said lugs being integrally formed with the carrier body and being of stepped configuration.

It is therefore possible to use the folder according to the invention not only in horizontal or upright position, but also directly suspended in a suspension file system without requiring any additional components. The carrier body is constituted by a single blank which is easily produced. The folder may be used with paper sheets of any desired size.

The folder will have increased stability for upright filing and at the same time an attractive appearance provided that, in accordance with a further modification of the invention, the lugs formed at bottom and cover have chamfered side edges which extend from the junctions between the creases and the outer edges of the lugs obliquely in the direction of the outer corner points of bottom and cover, respectively.

When the folder according to the invention is provided at the bottom thereof in the region adjoining the back with lateral support means and the support means are integral with the bottom and project transversely in the direction of the cover substantially perpendicularly to the bottom, the folder according to the invention will have a particularly high stability for placement in suspension file systems.

It has been found advantageous that the support means are flat webs or prisms which, when the folder is closed, include a leg extending substantially parallel to the back, and the support means are formed with stiffenings which are optionally broadened towards the bottom, whereby strength and stability of the folder are further improved.

In one embodiment of the folder the support means are joined to webs formed at the bottom and optionally disposed at right angles, and the webs extend in parallel relationship to the side edge or to the crease, respectively, whereby the stability of the folder is further improved. It is also possible to provide for securing of a paper stack in the folder.

It is an advantageous feature that the support means merge at the underside thereof into the broader region of the bottom to limit the same laterally, and that the support means have L-shaped configuration and include legs which extend in parallel relationship to the side edge and are flush with the side edges of the bottom. Thereby a compact and symmetrical arrangement is formed, which is favourable when the folder has to carry high loads.

In a special embodiment the support means are provided with a hook-shaped protrusion at the outer front edge thereof, whereby slipping of the folder into the suspension file system is prevented when the folder itself has a narrow back.

It is especially advantageous that the folder with its support means and optionally the stiffenings thereof is an integral injection-moulded or moulded article of plastics material. Plastics such as polyethylene, polyvinylchloride, polycarbonate, polyurethane or especially polypropylene are suitable materials, preferably with a wall thickness of 2 to 3 mm, and with a grained or structured outer surface.

When the bottom and/or back and/or cover of the folder include at least one region formed as a smooth surface on which an exchangeable, especially a pressure-sensitive label may be provided, the versatility of the folder in use is further improved, since outdated labels need no longer be pasted over.

In one embodiment of the folder of the instant invention, the smooth surfaces are shallow depressions in the respective walls of the carrier body, and the smooth surfaces are offset or stepped relative to the surrounding areas of the respective walls by a ring or ridge. Thereby the label edges are protected against mechanical wear and undesirable peeling of the label is prevented.

It has been found advantageous that the smooth surfaces are completely surrounded by the continuous elevated ring or ridge and that the ring or ridge is of flat design and forms a slight elevation of a few tenths of a millimetre relative to the respective smooth surface. The smooth surface may be offset in a decorative and functional manner relative to the surrounding areas while the elevation is in no way inconvenient.

Suitably, the smooth surfaces may be integrally formed with the plastics part as the carrier body and may be embossed in the respective region. Thereby the folders with the smooth surfaces may easily be produced in a single operation, for instance as an injection-moulded plastics part.

It has been found appropriate that a respective elongated slot is formed in the cover in parallel relationship to the side edge of the carrier body, each slot being disposed as the mirror image of the respective U-clamp of the line-up mechanism relative to the longitudinal axis of the back and having at least one resiliently bendable tongue which protrudes into the through-opening of the slot. Thereby a space-saving folder is produced, on the one hand, and the folder is effectively closed, on the other hand, because the folder cannot open by itself even if it is placed upright in a cabinet or suspended in a suspension file system.

The slots may have S-shaped configuration with two tabs protruding from opposite sides into the through-opening, and the width of the slots is approximately equal to twice the diameter of the U-clamps. The cover is thereby effectively locked, while the folder may readily be opened due to the spring-elastic properties.

In a special embodiment of the folder of the invention for paper sheets formed with a row of equidistant perforations along their margins, the carrier body is provided with fixtures at the predetermined spacing of the perforations, said fixtures being either integral with the carrier body or permanently joined thereto, and for receiving and locating the paper sheets there are provided U-shaped clamps of metal or a resilient material adapted to be secured in the fixtures, said U-clamps being formed on one leg thereof with a projection extending towards the other leg thereof. With the folder according to the invention the fixtures are either integral with the carrier body or permanently joined to the same, for instance by welding, riveting, glueing, screwing or tacking, while no complex operations are required therefor. The U-clamps are adapted for easy and quick release and renewed securing when papers are to be either removed or inserted.

In one embodiment of the folder of the instant invention the height of the U-clamps is approximately equal to the diameter of the circular arc portions, and the distance between the two legs is an odd multiple of the uniform spacing intermediate the perforation holes. Thereby the folder according to the invention is particularly suitable for EDP paper the marginal feed holes of which are utilized for securing and turning of the paper sheets.

In a special embodiment the fixtures include a first and a second open-topped recess with a transversely disposed lateral opening, the recesses being bores or blind holes optionally provided with countersunk portions in the inlet region. Thereby insertion of the U-clamps into the fixtures is aided and facilitated and a quickly releasable connection is provided.

In this connection it may be advantageous when the second recess formed in the fixture includes a vertical slot merging in the lower portion thereof into a horizontal slot, which is in part covered by the top side of the fixture while an opening is left clear. Such a folder with fixtures may be made by injection moulding in a single operation and ensures the required releasable mounting of the U-clamps.

It has been found suitable that the fixtures are formed with sliding faces extending via a retaining lug from the vertical slot into the clear opening. Thereby an effective locking of the U-clamps to the fixture is made possible.

Generally, the fixtures of the folder according to the invention are provided with locking elements which secure the respective U-clamp in its locked position against withdrawal from the recesses, whereby inadvertent dropping-out of the papers is prevented.

DESCRIPTION OF THE DRAWINGS

Additional features and advantages of the invention will become apparent from the following description of embodiments thereof with reference to the accompanying drawings, in which

FIG. 1 is a diagrammatic plan view showing the folder in the open state, the various parts being indicated only schematically. As will be apparent, a carrier body 20 consists substantially of three approximately rectangular portions, i.e., a bottom 21, a back 22, and a cover 23 disposed symmetrically to a longitudinal axis 29, the bottom 21, the back 22 and the cover 23 being interconnected by means of permanently foldable creases 26 and 27, respectively. The carrier body 20 may be made of metal, of plastics-reinforced paper or only of plastics material, the latter being preferred. The bottom 21 of the carrier body 20 is used for mounting a line-up mechanism of a commercially available type provided with U-clamps. Such line-up mechanisms are normally provided with U-clamps and are secured to the bottom 21, for instance, by means of rivets. In an illustrated embodiment shown in FIG. 1, the bottom 21 of the carrier body 20 is provided with two fixtures 40 which may be made of metal or plastics and are either integral with the carrier body 20 or permanently joined thereto, e.g. by injection-moulding or moulding or, respectively, by welding, riveting, glueing, tacking or the like. Appropriately, the fixtures 40 may also be made of the same material as the carrier body 20 itself. On the one hand, the fixtures 40 are disposed closely adjacent the side edges 25 of the carrier body 20 or the bottom 21, and on the other hand their end edges 51 are disposed in the immediate vicinity of the opposite crease 26 at the transition to the back 22. Each fixture 40 is provided with a U-clamp 70, the legs 71 of which are schematically indicated in FIG. 1. A respective one of the legs 71 of said U-clamps 70 is used for receiving and locating a stack of paper sheets 30 schematically indicated in the lower part of FIG. 1.

Figure 1:
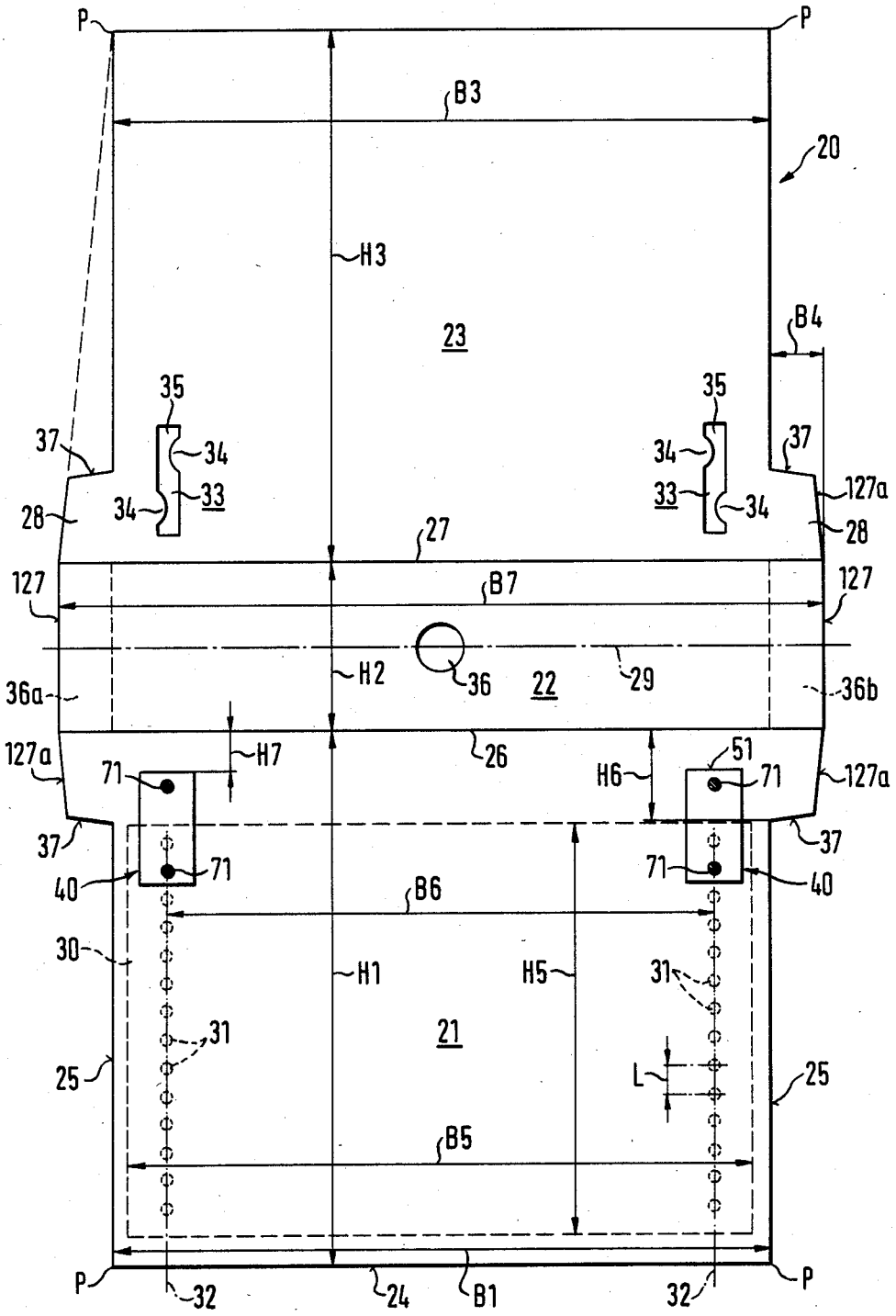
FIG. 1 is a diagrammatic plan view of a first embodiment of the folder according to the invention in open condition.

These paper sheets 30 may be of rectangular configuration and are provided with perforations 31 near their side edges, said perforations being disposed on a straight connecting line 32 and having the function of feeding and locating the paper sheets 30 in an electronic data processing system (EDP system). The paper sheets 30 extend, on the one hand, right near the lower edge 24 of the bottom 21 and, on the other hand, approximately to the middle of the two fixtures 40, where they may be releasably located by means of the U-clamps 70. The width of the paper sheets 30 is indicated at B5, the spacing between the two rows 32 of perforations 31 is indicated at B6, and the equal spacing between two adjacent perforated holes 31 is indicated at L. The height of the paper sheets 30 is indicated at H5. In one embodiment it is possible, for instance, to use the following dimensions: B5=305 mm, B6=232 mm, H5=9" or 228.6 mm, and L=0.5" or 12.7 mm.

As will be apparent from FIG. 1, the fixtures 40 with their U-clamps 70 or, respectively, the legs 71 are secured to the carrier body 20 at the predetermined spacing B6 and along the lines of the two rows 32 of perforations 31. In this way the U-clamps 70 have the function of accommodating and locating the paper sheets 30, which may be folded about their upper edge, the sheets being accommodated by the respectively opposite legs of the U-clamps.

FIG. 1 furthermore shows lugs 28 on either side of the side edges 25 in the region of the bottom 21, the back 22 and the cover 23. These lugs 28 should be provided at least in the region of bottom 21 and cover 23 so as to form integral support means intended for placing the folder in a commercially available suspension file system. It is also possible to provide recesses or cut-outs 36*a*, 36*b* in the region of the back 22 in order to save material and possibly to facilitate handling of the folder. The spacing of the laterally projecting lugs 28 relative to the side edges 25 is indicated at B4, so that the folder or the carrier body 20 has a greater overall width B7 in this region. The lugs 28 have a straight side edge 127 extending in parallel to the side edges 25 and adjoin the latter via a respective shoulder 37 so that the stepped lugs 28 result. Either additionally or alternatively, the back 22 may also be formed with a possibly circular cut-out 36 functioning as a handling hole to facilitate handling of the folder.

As will be apparent from FIG. 1, the wider regions of bottom 21, back 22 and cover 23 are respectively equal-sized and of symmetrical configuration on either side, so that the step-like, substantially rectangular lugs 28 result. Appropriately, the side edges 127 may gradually merge into chamfered side edges 127*a*, which extend from the junctions between the creases 26, 27 and the straight outer edges 127 of the lugs 28 at an inclination towards the outer corner points P from the bottom 21 and the cover 23, respectively. Thereby the carrier body achieves an attractive exterior, and the slightly chamfered side edges 127*a* improve the stability of the folder when the latter is placed in upright position in a piece of furniture. The shoulders 37 also may be slightly chamfered or may include a right angle with the side edges 25.

With the embodiment illustrated in FIG. 1, the shoulders 37 of the stepped lugs 28 are disposed approximately at the level of the centre of the fixtures 40 or their U-clamps 70, respectively. This has been found advantageous for placing such a folder in a suspension file system, wherein it will rest with its lugs 37 on the parallel suspension rails of the suspension file system.

In the embodiments shown in FIGS. 2 to 5 the carrier body 20 is provided with reinforcements or supports for the lugs, which in this embodiment are referenced 124. Bottom 21, back 22 and cover 23 are flat members and are interconnected through permanently foldable creases 128 and 129. The bottom 21 has a region 126 intermediate the crease 129 and a dashed line 126*a* which is used to accommodate and secure a line-up mechanism (not shown) of a commercially available type.

To improve the carrying capacity of the folder or carrier body 20, the region 126 adjoining the back 22 is provided with lateral support members 130 formed integrally with the bottom 21 and projecting transversely, substantially perpendicularly to the bottom 21. When the folder is closed, these support members 130 extend in the direction of the cover 23 and are designed as flat webs or prisms which in the closed condition of the folder extend in substantially parallel relationship to the back 22.

Figure 2:
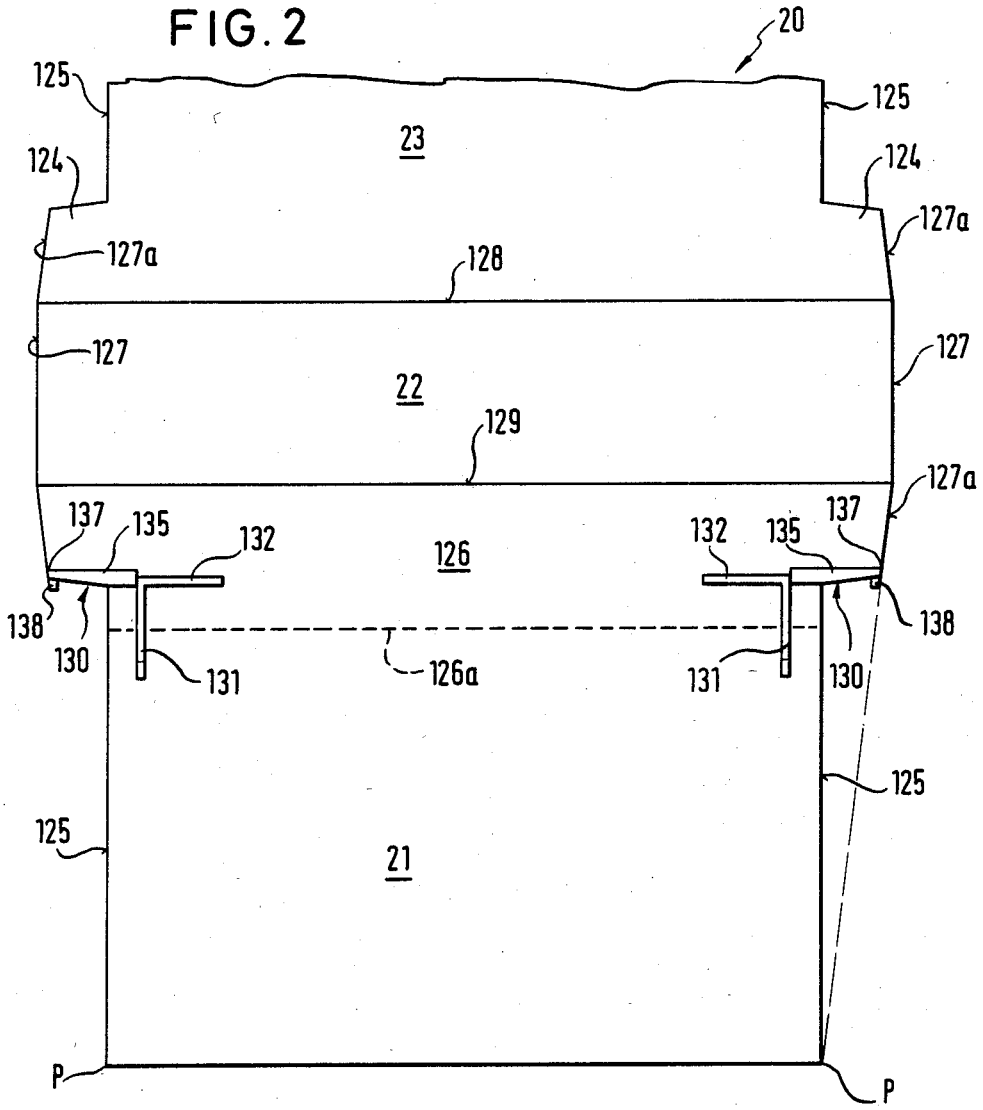
FIG. 2 is a diagrammatic partial plan view of another embodiment of the folder in open condition.

In this embodiment the outer edges 127 of the lugs 124 also may be formed with chamfered side edges 127*a* which extend, as described above, towards the corner points of either the bottom 21 or the cover 23. In the illustrated embodiment, the support members 130 extend from the outer edge 127 or 127*a* of the wider portion of the lugs 124, respectively, beyond the side edges 125 of the bottom 21 into the interior region; they may be formed with a slight taper both in the direction of the outer edge 127 or 127*a* and in the direction of their upper edge. This taper towards the outer edge 127 or 127*a* is schematically indicated in FIG. 2. To improve the stability, the support members may be provided with reinforcements or stiffenings.

In one embodiment the support members 130 widen towards the bottom 21. In addition to this measure, or as an alternative, the support members 130 may be joined to webs 131 and/or 132 which may be disposed at right angles to each other and appropriately extend in parallel to the side edge 125 and the crease 129, respectively.

Thus the webs 131 and 132 have a dual function, because on the one hand they contribute to the stability of the support members 130 and thus of the folder in the suspended position thereof, and on the other hand they form bearing portions for a stack of paper sheets (not shown) accommodated by the carrier body in use.

In another embodiment not illustrated here, the lugs 124 in the region of the bottom 21 and/or of the back 22 and/or of the cover 23 may be omitted, and then the support members 130 increasingly or solely accommodate the weight of the folder when the same is suspended in a suspension file system. As will be apparent from FIG. 2, the support members 130 merge with their underside into the wider region of the bottom 21 and thus form a lateral boundary or limit for the respective lug 124, so that a compact and stable arrangement having an attractive appearance is formed.

Figure 3:
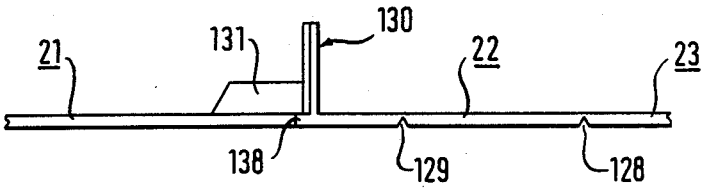
FIG. 3 is a partial side view of the folder shown in FIG. 2 as seen from the right.

From the fragmentary side view of FIG. 3 parts of the bottom 21 and of the back 22 adjoining via the crease 129 will be apparent. One support member 130 of the pair of support members 130 projects from the bottom 21 transversely and substantially upright relative to the bottom 21. Furthermore a web 131 will be apparent, which is joined to both the support member 130 and the bottom 21 so that a triangular connection is obtained which results in increased stability.

From the embodiment illustrated in FIGS. 2 and 3 it is further apparent that the support members 130 each have a protrusion 138 near their front edges 137. These protrusions 138 extend substantially in parallel to the side edge 125 of the bottom 21 and constitute extensions of the respective outer edge 127 or 127*a* of the wider lug 124. These protrusions 138 are hook-shaped and extend approximately at right angles from the legs 135 of the support members 130 so that they improve placement of the folder in a suspension file system and inhibit the folder from falling completely into the cabinet of the suspension file system when the respective compartment is only slightly filled and/or the back 22 has a small width.

Figure 4:
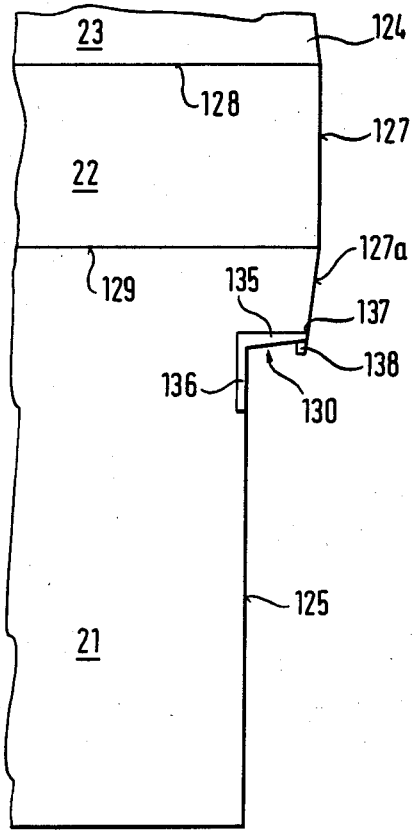
FIG. 4 is a diagrammatic partial plan view showing a further embodiment of the folder.
Figure 5:
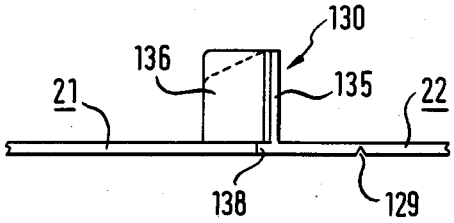
FIG. 5 is a partial side view of the folder shown in FIG. 4 as seen from the right.

A further embodiment of the folder is illustrated in FIGS. 4 and 5, wherein FIG. 4 only shows a fragmentary plan view of the right-hand part. It will be apparent that the support member 130 includes a leg 135 extending substantially in parallel to the back 22 or to the crease 129 and a leg 136 provided at right angles thereto, so that in the end an L-shaped support member 130 results. Appropriately, the leg 136 extends in flush relationship with the side edge 125 of the bottom 21, so that smooth transitions from the support member 130 to the respective adjoining walls will result. In this embodiment, too, a hook-like protrusion 138 is provided near the front edge 137 of the leg 135 or the support member 130, respectively, the function of said protrusion being similar to that already described.

FIG. 5 is a side view from the right of such an embodiment. It will be apparent that the leg 136 forms a wall in continuance of the leg 135. This triangular or angle structure results in a particularly robust and compact configuration of the support members 130 or the folder intended for a suspension file system, said configuration having a high carrying capacity. Although the height of the leg 136 in the embodiment of FIG. 5 is equal to that of the leg 135, the folder is certainly not limited to such a configuration. Rather, the leg 136 may also be of lesser height, or it may have an oblique upper edge as indicated in dashed lines in FIG. 5. The stability of the support member 130 is not impaired thereby. On the opposite side of the carrier body a complementary support will then be provided on the bottom 21 so as to ensure uniform load accommodation.

In practice, it has been found advantageous to manufacture such a folder with its support members 130 and possibly with the reinforcements therefor in the form of webs or legs as a unitary plastics article, for instance as an injection-moulded or a moulded article. It is then possible to manufacture the folder in a simple way in one operation, and the folder will exhibit the desired good carrying capacity and stability for practical use in a shelf or a suspension file system.

Suitable materials for such office supplies are conventional rigid or possibly elastic plastics such as polyethylene, polyvinylchloride, polycarbonate or polyurethane, or especially polypropylene, although the invention is not limited to the aforementioned plastics. The unitary folder of polypropylene may have a structured or grained outer surface. Small wall thicknesses of only about 2 to 3 mm for the bottom 21, the back 22 and the cover 23 will be sufficient, and no large-area stiffenings for the folder itself, such as used in conventional folders, will be required, because a plastic such as polypropylene exhibits the favourable properties of sufficient rigidity and strength in the region of the flat parts, on the one hand, and on the other hand has the desired elasticity in the region of the hinge-forming creases 128 and 129. Therefore the mentioned stiffenings are provided only for the load-absorbing support members 130 but not for stiffening the folder as a whole. Such a material can be readily processed and the grained or structured outer surface thereof is insensitive to scratches in use.

Figure 6:
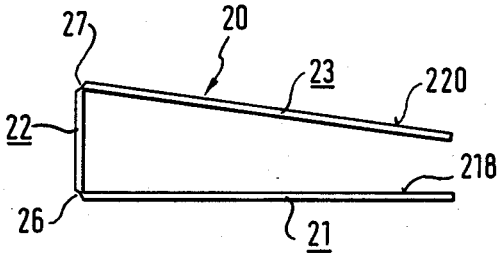
FIG. 6 is a diagrammatic side view of the folder according to the invention.

FIG. 6 is a diagrammatic side view of the folder, in which the carrier body is referenced 20. In the illustrated embodiment the bottom 21, the back 22 and the cover 23 are interconnected by means of permanently foldable creases 26 and 27, respectively, and form flat parts or walls to which labels may be applied, if desired. The inside of the carrier body 20 is referenced 218, while the outside thereof is referenced 220.

Figure 7:
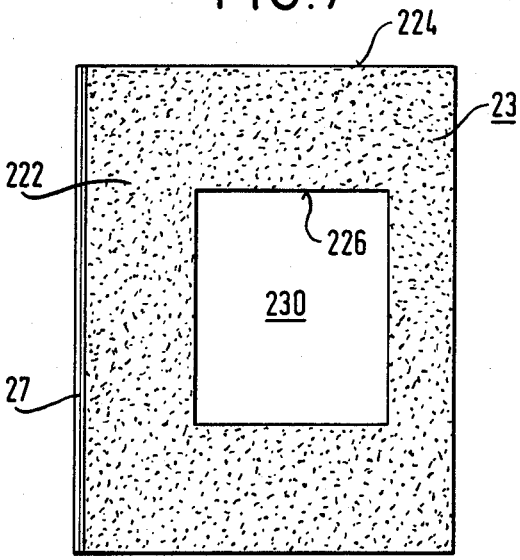
FIG. 7 is a diagrammatic plan view of the folder shown in FIG. 6.

FIG. 7 is a diagrammatic plan view showing the cover 23 of the carrier body 20, in which a smooth surface 230, which may be of rectangular shape, is distinctly offset relative to the surrounding area 222. The area 222 may be structured, mottled, rough, grained or the like. The outer edge of this area 222 and thus of the cover 23 is referenced 224, the inner edge of the area 222 is defined by a schematically indicated ring or ridge 226.

On such a smooth surface 230 it is possible to apply an exchangeable label, preferably a pressure-sensitive label which may be removed again, if desired. Of course, such smooth surfaces 230 may be provided not only on the cover 23 of the carrier body 20 but also on other parts of the folder, for instance in the region of the bottom 21 or the back 22 on both the outside 220 and the inside 218.

Figure 8:
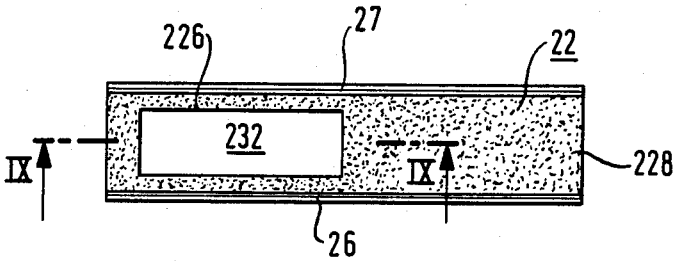
FIG. 8 is a diagrammatic plan view of the back of the folder shown in FIG. 6.
Figure 9:
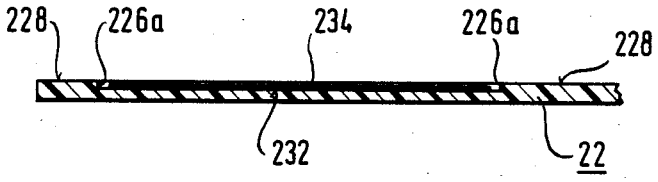
FIG. 9.

FIG. 8 shows a further embodiment in a partial view of the back 22, on which a smooth surface 232 is symmetrically provided which is surrounded by a structured area 228. Between the smooth surface and the area 228 there is provided a transitional region in the form of an edge, a ring or a ridge 226. Details will be apparent from FIGS. 9 and 10, which are sectional views of the embodiment illustrated in FIG. 8, wherein a label 234 is applied to the smooth surface 232. In FIG. 9, the smooth surface 232 is a shallow depression in the back 22 and adjoins the somewhat higher surrounding area 228 via the schematically indicated edge 226*a*. FIG. 9 shows that the label 234 is securely placed in the depression of the smooth surface 232; in particular the outer edges of the label 234 are protected against mechanical wear, dog ears and accidental peeling, because the user of the folder will not normally get caught by the label 234 or the label edge.

Figure 10:
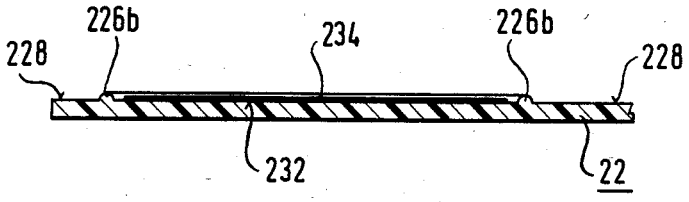
FIG. 10 are diagrammatic sectional views of the folder shown in FIG. 8 along the line IX—IX.

In the embodiment illustrated in FIG. 10 a ring or ridge 226*b* is provided which protrudes outwardly with respect to both the smooth surface 232 and the surrounding area 228. The ring or ridge 226*b* completely surrounds the smooth surface 232, so that the applied label 234 is protected on all sides.

In the embodiments shown in FIGS. 9 and 10 the height of the edge 226*a* and of the ring or ridge 226*b* will amount to only a few tenths of a millimetre by which this part protrudes from the smooth surface 232. As schematically indicated in FIGS. 9 and 10, the height of the edge 226*a* or of the ring 226*b* will be chosen such that normally it will somewhat exceed the thickness of conventional labels 234, whereby the desirable protection against inadvertent removal is provided.

According to FIG. 10 the ring or ridge 226*b* may be of semi-circular cross-section, but it may as well have rectangular, triangular or trapezoidal cross-section. In this respect the design is in no way limited, the various areas may also be offset against each other by different colours, if desired.

Appropriately, at least the region of the smooth surfaces 230 and 232, respectively, will be made of metal or plastics. From the viewpoint of manufacturing it has been found advantageous to make the carrier body 20 entirely from plastics material with the respective smooth surfaces 230 or 232 embossed therein; in an injection-moulded or a moulded plastics part they are, for instance, formed as moulded smooth surfaces 230 or 232. It is thus possible to manufacture the carrier body 20 in a single operation without any secondary processing being required to form the smooth surfaces 230 or 232, respectively.

Such an arrangement has already been found highly satisfactory in practical use, since it is possible on the one hand to apply the labels so that they are protected and, on the other hand, outdated labels may readily be replaced and old ones need not be pasted over.

Below, reference will first be made to FIG. 1. It will be apparent that in the arrangement of FIG. 1 a pair of elongated slots 33 is provided as mirror images of the fixture 40 relative to the longitudinal axis 29 of the back 22, said slots being disposed in parallel to the side edge 25 of the carrier body 20 in the cover 23 and having resiliently bendable tabs 34 protruding into the respective through-openings 35 of the slots 33. The slots 33 have S-shaped configuration including two tabs 34 protruding from opposite sides into the through-opening 35, although the folder is not limited to such an arrangement. If desired, a pair of such tabs 34, which are disposed in the respective slots 33 either in facing relationship or in oppositely directed relationship, will also be sufficient.

These slots 33 with their tabs 34 have the function of coming into engagement with the oppositely disposed U-clamps 70 of the fixtures 40 when the folder is closed, whereby the folder is kept closed, on the one hand, and the stack of paper sheets 30 is urged against the bottom 21 and is thereby secured in the folder, on the other hand. Appropriately, the slots have a width which is approximately equal to twice the diameter of the material of the U-clamps 70, the tabs 34 protruding transversely approximately to the middle of the slots 33. It is thereby possible to achieve reliable locating of the cover 23 in the U-clamps 70, while opening of the folder does not pose a problem because the tabs 34 are capable of being resiliently deflected.

In the arrangement shown in FIG. 1 the following reference characters are additionally used: width and height of the bottom 21 are referenced H1 and B1, respectively; the height of the back 22 is referenced H2; height and width of the cover 23 are referenced H3 and B3, respectively.

Figure 11:
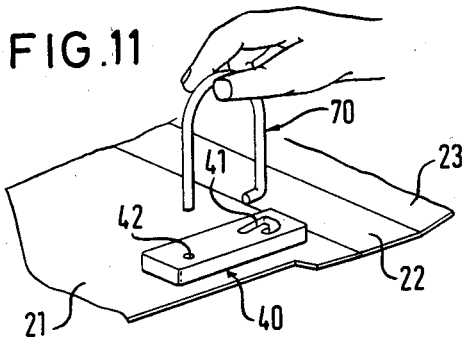
FIG. 11 is a diagrammatic perspective view of the folder including a fixture into which a U-clamp is being inserted.

The mode of operation of the folder according to the invention will be explained in detail with reference to FIGS. 11 to 15, which are diagrammatic perspective fragmentary views illustrating the various stages during which such a folder is filled with paper sheets and closed. FIG. 11 shows portions of such a folder with bottom 21, back 22 and cover 23, a fixture 40 into which a U-clamp 70 is to be inserted being schematically indicated on the bottom 21.

Figure 12:
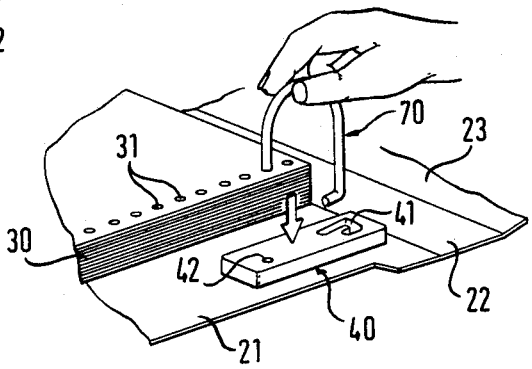
FIG. 12 is a diagrammatic perspective view in which a stack of paper sheets together with the U-clamp is being inserted into the fixture.

FIG. 12 shows the next stage, in which a stack of paper sheets 30 having perforations 31 has been threaded onto one of the legs of a U-clamp 70. The U-clamp 70 is placed downwardly onto the fixture 40, as indicated by the arrow, so that it will be brought into engagement with the two open-topped recesses 41 and 42 of the fixture 40.

Figure 13:
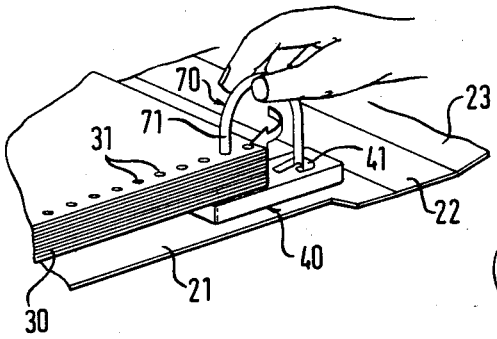
FIG. 13 is a diagrammatic perspective view of the next-following stage, in which the U-clamp is already inserted in the fixture and is just being secured therein.

FIG. 13 shows the next stage, in which the stack of paper sheets 30 is already located on the fixture 40 by means of the U-clamp 70. The two legs 71 of the U-clamp 70 have been inserted into the open-topped recesses, and one of the legs is turned about the axis of the other leg so that the projection thereof may be moved beneath a locating projection of the fixture and secured against dropping out.

Figure 14:
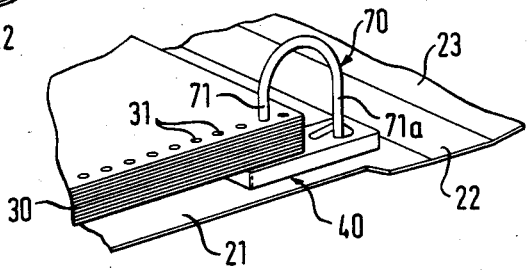
FIG. 14 is a diagrammatic perspective view, in which the U-clamp is locked in the fixture and one of the legs of the U-clamp locates a stack of paper sheets.

The next stage is illustrated in FIG. 14, where the stack of paper sheets 30 together with the U-clamp 70 is completely located in position on the fixture 40. One leg 71 extends through the registering perforations of the paper sheets 30, while the other leg 71*a* is located in position on the opposite side in the fixture 40.

Figure 15:
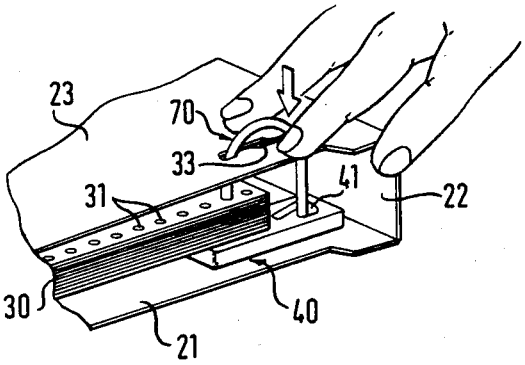
FIG. 15 is a diagrammatic perspective view of the folder filled with paper sheets and being in its closed state.

Finally, FIG. 15 illustrates the closed condition of the folder, in which the bottom 21, the back 22 and the cover 23 define a U-shaped arrangement accommodating the stack of paper sheets 30 in the interior thereof. The cover 23 is pressed downwardly, so that the U-clamp 70 extends with its circular arc portion through the slot 33 in the cover 23, whereby the cover is secured against being opened.

As will be apparent from the various figures of the drawing, the U-clamps 70 are of unitary and U-shaped configuration, and the ends of their legs 71 and 71*a* are releasably joined to the respective fixture 40. Therefore the U-clamps 70 do not have an edge like conventional U-clamp assemblies, in which the top and bottom part of a U-clamp may be opened for the removal of paper sheets. Due to the continuous smooth surface along the length of the U-clamps 70 any damage to the paper sheets 30 is reliably prevented, especially when single paper sheets 30 of a stack are turned over. Appropriately, the U-clamps are made of metal or some other strong material having a certain degree of elasticity, for instance of iron, wherein the surface thereof may optionally be polished or chromium-plated. These U-clamps may be inserted into the fixtures 40 with their legs 71 and 71*a* so that they are secured against withdrawal and dropping-out. Further details will be apparent from the following description with reference to the FIGS. 16 to 23.

Figure 16:
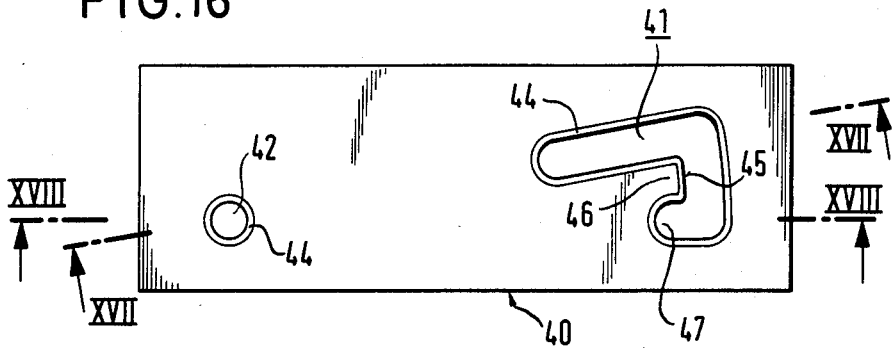
FIG. 16 is a diagrammatic plan view showing a fixture with its open-topped recesses.

FIG. 16 is a diagrammatic plan view of a fixture 40 having a first recess 41 and a second recess 42, both recesses being open-topped. The recess 42 is a blind hole or vertical hole, a countersunk portion 44 being formed at the top 40*a* of the fixture 40, as will be apparent from FIGS. 16 to 18. The other recess 41 is formed as a slot and has hook-like configuration when seen in plan view, as will be apparent from FIG. 16. This second recess 41 includes a linear slot portion facing towards the recess 42, and an arcuate portion which extends from the linear portion via a transitional portion into an opening 47, which likewise forms an open-topped opening 47. Intermediate the linear slot portion of the recess 41 and the opening 47 there is provided a retaining lug 46 having a sliding face 45 somewhat outwardly offset relative to the opening 47. In its lower portion the vertical slot 41 merges into a horizontal slot 43, which is in part covered by the top 40*a* of the fixture 40, while the opening 47 is left clear. As viewed in cross-section, the retaining lug 46 therefore produces an L-shaped connection between the vertical slot 41 and the horizontal slot 43.

Figure 17:
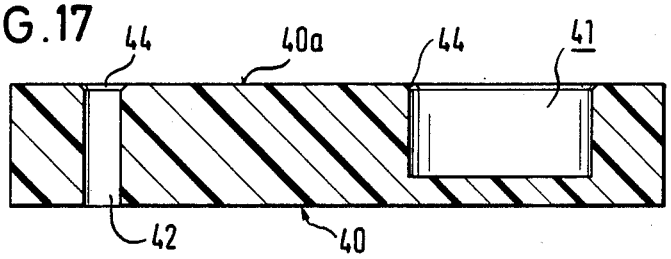
FIG. 17 is a diagrammatic sectional side view of the fixture along the line XVII—XVII of FIG. 16.
Figure 18:
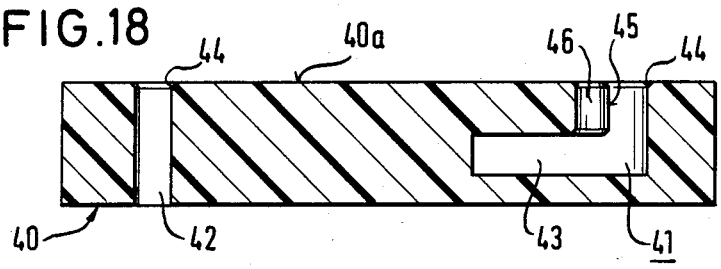
FIG. 18 is a diagrammatic sectional side view of the fixture along the line XVIII—XVIII in FIG. 16.

The FIGS. 17 and 18 are diagrammatic sectional side views through the fixture including the two recesses 41 and 42. It will be apparent that the U-clamp 70, which is shown in detail in FIG. 19, may be inserted with its leg 71 into the recess 42 and with its other leg 71*a* including the projection 73 into the recess 41 in the manner shown in the sectional view of FIG. 17. Thereupon the U-clamp 70 is turned about the axis of its leg 71 while it slides along the sliding face 45 of the recess 41 or the retaining projection 46, respectively, and is elastically deflected outwardly. Then, the elastic U-clamp snaps back with its leg 71*a* to latch in the opening 47 behind the retaining projection, so that the projection 73 of the U-clamp 70 will then be seated in the slot 43 beneath the retaining projection 46 to be thereby retained against withdrawal and dropping-out.

It is therefore possible in a simple way to locate the U-clamp 70 in the fixture and to release it from its locked position, because nothing but a plugging motion with a subsequent turning motion, or vice versa, is required to close or open the U-clamp assembly. Appropriately, the upper edge of the slot 41 is also provided with a countersunk portion or chamfer 44, as will be apparent from the drawing. The retaining lug 46 with its sliding face 45 forms a kind of snap mounting for the U-clamp.

Figure 19:
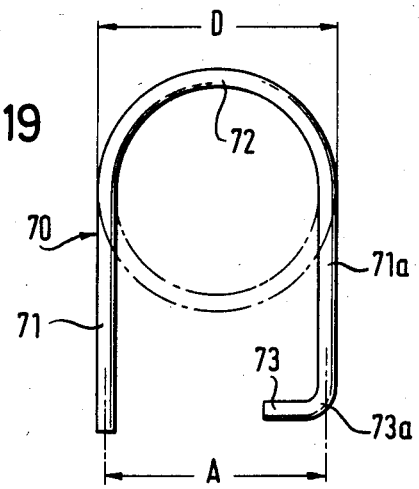
FIG. 19 is a diagrammatic side view of a U-clamp for the folder according to the invention.

As will be apparent from FIG. 19, each U-clamp 70 comprises two substantially parallel legs 71 and 71*a* joined to each other through a circular arc portion 72. The height of each U-clamp 70 is approximately equal to the diameter D of the circular arc portion 72. The distance A between the two legs 71 and 71*a* suitably is an odd multiple of the uniform spacings L between the perforation holes 31. This distance A between the two legs 71 and 71*a* also determines the approximate height of the stack of paper sheets 30 that may be accommodated in the folder without any difficulties during turning-over of the sheets and without any damage to the creases in case a concertina-type paper stack is concerned.

Each U-clamp 70 is made of a strong material having elastic properties, for instance of iron, the one leg 71*a* of the U-clamp 70 having L-configuration at the end thereof and including a projection 73 which merges via a rounded portion 73*a* into the leg 71*a*.

Figure 20:
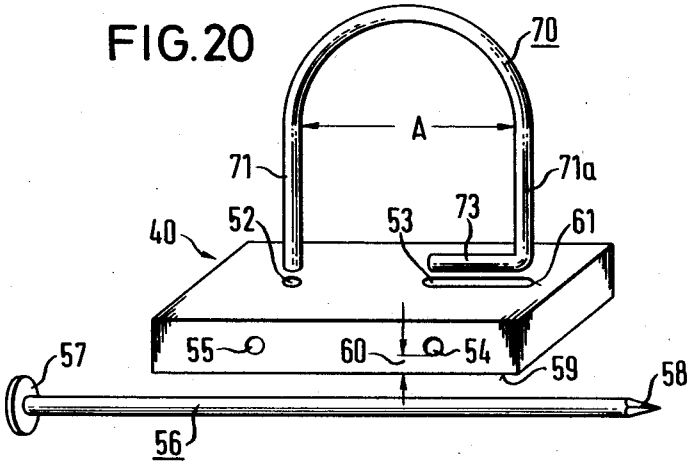
FIG. 20 is a diagrammatic perspective view of a further embodiment of a fixture and U-clamp for the folder according to the invention prior to assembly.

Another embodiment of fixture 40 and U-clamp 70 is illustrated in the FIGS. 20 to 23. The perspective view of FIG. 20 shows a fixture 40 including a hole 52 and an elongated slot 53, which form the open-topped recesses. Furthermore, a transverse hole 54, which optionally is a through-hole, is formed at least in the region of the slot 53, said transverse hole 54 extending in spaced relationship above the bottom 59 of the slot 53. For the sake of clarity, the bottom of the slot 53 is shown to be identical with the bottom of the fixture 40. The upper end of this slot is then formed by the upper side of the bottom 21 of the carrier body 20 on which the fixture 40 is either mounted or integrally formed therewith. The spacing 60 of the transverse hole 54 above the bottom of the slot 53 is at least equal to the diameter of the material of the U-clamp 70 or its projection 73, respectively, so that the U-clamp 70 inserted in the fixture 40 may be secured.

The hole 52 and the remote outer edge 61 of the slot 53 in the fixture 40 have a spacing from each other which is at least equal to the distance A between the legs of the U-clamp 70, so that the U-clamp 70 may be inserted from above in a simple manner. For securing purposes a pin 56 is provided, which has a broad head 57 while the opposite end forms a pointed end 58. The pin is made of a strong, possibly flexible, elastic material having such a diameter as to be detachably insertable into the fixture above the projection 73 of the U-clamp 70.

Only one transverse hole 54 is required for insertion of said pin. In the manner shown, however, it is also possible to provide two such transverse holes 54 and 55 in spaced relationship, so that one transverse hole 55 always serves to accommodate the pin 56, whereas the opposite, pointed end 58 thereof is withdrawn, if required, out of the other transverse hole 54 in order to permit insertion or removal of a U-clamp 70. In this way the pin 56 cannot be lost in use, because it is always held captive in the fixture 40. Alternatively, such a pin 56 may also be permanently joined to the fixture 40 or may be integrally formed therewith, so that the pin 56 will always be available.

Figure 21:
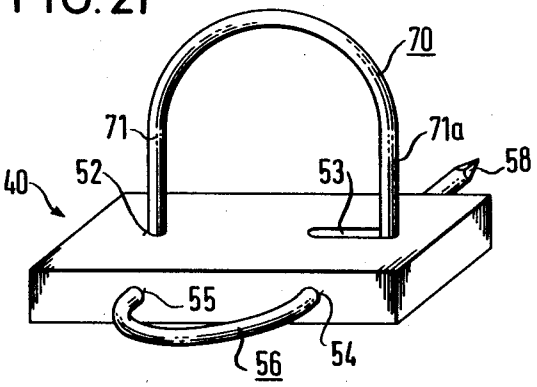
FIG. 21 is a diagrammatic perspective view of the fixture and U-clamp according to FIG. 20 in assembled state.
Figure 23:
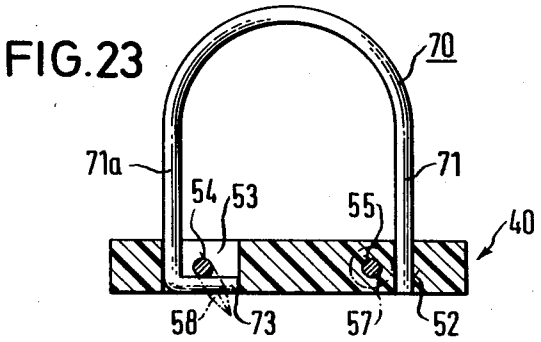
FIG. 23 is a sectional view similar to FIG. 22 showing the arrangement according to FIG. 21 from the opposite side.
Figure 22:
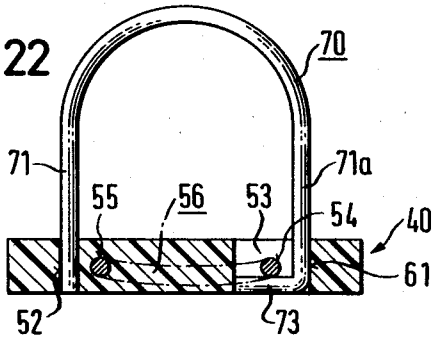
FIG. 22 is a sectional view through the fixture and U-clamp in the assembled state of the arrangement shown in FIG. 21.

The FIGS. 21 to 23 show the assembled state of fixture 40 and U-clamp 70 in different views. It will be apparent that the pin 56 is inserted through the one transverse hole 55 so that the head 57 abuts the side edge of the fixture 40. The pin 56 is then drawn out in an arc and inserted through the other transverse hole 54, wherein it extends over the projection 73 of the leg 71*a* of the U-clamp and thus locks the U-clamp 70 in the fixture 40.

The slot 53 need not necessarily be disposed in register with the perforation holes 31 of the paper sheets; what is important merely is that its outer edge 61 is disposed along the line of the row 32 of perforation holes 31. The projection 73 and the slot 53 together may have any desired orientation, wherein the transverse hole 54 has to be aligned correspondingly so that the pin 56 may extend over the projection 73 to thereby secure the U-clamp 70.

It should be noted that the fixtures 40 may also be formed with a plurality of relatively spaced aligned recesses 42 in the form of open-topped holes so that U-clamps 70 with different spacings between the legs 71, 71*a* may be accommodated if the U-clamps 70 are to be exchanged or the fixtures 40 are to be used for different types of folders. It should merely be observed that the spacing of the recesses 42 from the opposite recess 41 or the outer edge 61 of a slot 53, respectively, is an odd multiple of the equal spacings of the perforation holes, i.e., said spacing should have the values of L, 3L, 5L, . . . . In accordance with the usual inch-system dimensions of paper sheets used in EDP systems, these spacings between the two recesses in the fixture 40 and the equal-size spacings between the legs 71 and 71*a* of the U-clamps 70 will be chosen to be either 38.1 mm or 64.5 mm; this corresponds to a spacing L of the perforation holes of ½", which is commonly used.

It should be added in respect of the diagrammatic view of FIG. 1 that the fixtures 40 ought to be disposed with their one end face 51 either in the direct vicinity of, or slightly spaced from, the opposite permanently foldable crease 26 so as to achieve a highly compact arrangement. The spacing H7 between this crease 26 and the end face 51 may be about one centimetre. The height H2 of the back 22 is selected to be about equal to the (free) height of the U-clamps 70, i.e., approximately equal to the diameter D of the circular arc portion 72 of the respective U-clamp 70. It is thereby readily possible to close the carrier body 20 to U-shape, so that the U-clamps 70 with their circular arc portions 72 can extend through the slots 33 in the cover 23.

The U-clamps 70 themselves have circular cross-section with a diameter of 1 to 3 mm, preferably about 2 mm, so that the stacks of paper sheets may readily be placed thereon with their perforation holes. The thickness of the material for the carrier body 20 may be selected in a suitable manner and will be about 2 mm in case of a particularly advantageous material such as polypropylene, so that both the required strength and the desired elasticity are provided in the region of the slots 33 and the tabs 34, respectively. Appropriately, these slots 33 are provided at locations which are opposite to the U-clamps 70 and in the same numbers as the U-clamps, wherein it is merely necessary to provide one or two slots 33 with the flexible tabs 34.

When EDP continuous stock of 305 mm×9" (=228.6 mm) is used, a carrier body 20 will be used whose bottom 21 and cover 23 each have a width B1 and B3, respectively, of 320 to 330 mm and a height H1 and H3, respectively, of 250 to 270 mm. The centre of the U-clamps 70 may have a spacing of about 230 mm from the bottom edge 24 of the carrier body 20, so that the paper stack will not protrude from the bottom edge 24. The shoulders 37 of the lugs 28 may be disposed approximately at the level of the centre of the U-clamps 70, as will be apparent from FIG. 1. The distance of the shoulders 37 of the lugs 28 from the next-adjacent crease 26 or 27, respectively, is referenced H6 and amounts to approximately 30 to 40 mm. This will result in the required strength of the arrangement when the folder filled with paper sheets 30 is placed in a suspension file system with these lugs 28 serving as support means. It will be sufficient when the lugs 28 protrude laterally beyond the side edges 25 of the carrier body 20 by a width B4, which is about 10 mm.

With a folder of the kind described above it will be advantageous to fill the U-clamps 70 with paper sheets up to half the height of the U-clamps, because in that case easy closing of the folders by depressing the cover 23 will be ensured. Of course, it will also be possible with a folder of the kind described above to provide an additional clamping strip formed with openings in the region of the two U-clamps 70; said clamping strip may be run onto the U-clamps 70 prior to threading a stack of paper sheets 30 thereon, whereby securing of a stack of paper sheets during storage is aided. However, such a clamping strip is by no means necessary.

Such and further changes and modifications of the explained embodiments which are recognizable to those skilled in the art upon study of the above papers shall also be covered by the present invention as long as they can be subsumed under the subject-matter of the following patent claims and/or the equivalents thereof.

I claim:

1. A folder for paper sheets or the like, comprising a carrier body (20), said body including a bottom (21) and a back (22) and a cover (23) having adjoining portions joined to each other by means including permanently foldable creases (26,27), said bottom (21) having a line-up means for aligning the paper sheets, characterized in that at least the adjoining portions of said bottom (21) and of said cover (23) adjoining said back (22) have a width (B7) in excess of the width of the remaining portions (B1,B3) of said bottom (21) and of said cover (23), and that said adjoining portions having said width define a substantially rectangular configuration and defining symmetrical lugs (28) of equal size on either side of said back (22), said lugs being integrally formed with the carrier body (20) and defining a stepped configuration.

2. A folder as claimed in claim 1, characterized in that the lugs (28) formed at said bottom (21) and said cover (23) have chamfered side edges (127*a*) which extend from the junctions between the creases (26, 27) and the outer edges (127) of the lugs (28) at an inclination directed towards the outer corner points (P) of the bottom (21) and cover (23), respectively.

3. A folder as claimed in claim 1 characterized in that in a portion (126) of said cover (31) adjoining the back (22) includes lateral support means (130), said lateral support means (130) being integral with the bottom (21) and projecting transversely in the direction of the cover (23) and substantially perpendicularly outwardly of the bottom (21).

4. A folder as claimed in claim 3, characterized in that said lateral support means (130) include flat webs projecting from said bottom, each of said flat webs includes a leg (135) extending substantially parallel to the back (22) with said back folded on said foldable creases (26, 27), and each of said legs includes a stiffening portion which is preferably broadened towards the bottom (21).

5. A folder as claimed in claim 3 characterized in webs (131, 132) generally L-shaped with web portions substantially at right angles, and said web portions (131, 132) extend in parallel relationship to the side edge (125) and to the foldable crease (129), respectively.

6. A folder as claimed in claim 3 wherein said support means (130) is substantially L-shaped and includes a member which merges at the underside thereof into the wider portion of the bottom (21) to limit the same laterally, and support legs (136) which extend in parallel relationship to and are flush with the side edges (125) of the bottom (21).

7. A folder as claimed in claim 3 characterized in that the support means (130) are provided with a hook-shaped protrusion (138) at the outer front edge (137) thereof.

8. A folder as claimed in claim 3 wherein said cover and back and bottom including said lugs and support means is an integral moulded article of plastics material, selected from plastic materials selected from the group consisting of polyethylene, polyvinylchloride, polycarbonate, polyurethane and preferably polypropylene, said cover and back and bottom preferably having a wall thickness of 2 to 3 mm, and having a grained or structured outer surface.

9. A folder as claimed in claim 1 wherein at least one of said bottom (21) and back (22) and cover (23) includes at least one region formed as a smooth surface (230, 232) adapted to releasably receive a label member (234).

10. A folder as claimed in claim 9, characterized in that each said smooth surface (230, 232) is a shallow depression said smooth surface (230, 232) is offset relative to the surrounding areas (222, 228) of the body (21, 22, 23) by a ridge (226, 226*a*,226*b*).

11. A folder as claimed in claim 10, characterized in that the ridge (226, 226*a*, 226*b*) completely surrounds said surface, and each said ridge (226*a*, 226*b*) is of flat design and forms a slight elevation of a few tenths of a millimetre relative to the smooth surface (230, 232).

12. A folder as claimed in claim 9, chracterized in that each smooth surface (230, 232) is integrally formed with the carrier body (20), and the surrounding body is embossed.

13. A folder as claimed in claim 1, wherein said line-up means includes a U-clamp at each side of the bottom, an elongated slot (33) is formed in each side of the cover (23) in parallel relationship to each side edge (25) of the carrier body (20), each said slot defining a through-opening aligned with one of said U-clamps and being disposed as the mirror image of the U-clamp (70) relative to the longitudinal axis (29) of the back (22) and having at least one resiliently bendable tab (34) which protrudes into said through-opening (35) of the slot (33).

14. A folder as claimed in claim 13, characterized in that the slot has an S-shaped configuration with two tabs (34) protruding from opposite sides into the through-opening (35), and said slot (33) having a width approximately equal to twice the thickness of the U-clamps (70), said tabs (34) protruding transversely to about the middle of the slots (33).

15. A folder as claimed in claim 1, for EPD paper sheets formed with a row of equi-distance perforations (31) along their margins, characterized in that fixtures (40) are secured to said body in accordance with predetermined spacing corresponding to the spacing of the perforations (31) and form a permanent part of said folder, U-shaped clamps for receiving and locating of the paper sheets (30), said U-shaped clamps being resilient and (70) adapted to be secured in the fixtures (40) and defining said aligning means, said U-shaped clamps having one leg (71*a*) with a projection (73) extending towards the other leg (71) and mating with said slot.

16. A folder as claimed in claim 15, characterized in that said U-clamps (70) have a height approximately equal to the diameter (D) of the circular arc portion (72) of the clamp, and the two legs (71, 71*a*) are spaced by a distance (A) equal to an odd multiple of the uniform spacing (L) intermediate the perforation holes (31).

17. A folder as claimed in claim 15, characterized in that each fixture (40) is formed with a first open-topped recess (42) and a second open-topped recess (41) with a transversely disposed lateral opening (43), the recesses being blind holes.

18. A folder as claimed in claim 17, characterized in that said second open-topped recess (41) is formed in the fixture (40) including a vertical slot (41) merging in the lower portion thereof into said lateral opening (43), said lateral opening (43) having a portion thereof in a top portion of the fixture (40) and having an unrestricted opening (47).

19. A folder as claimed in claim 18, characterized in that the fixtures (40) includes sliding faces (45) extending from a retaining lug (46) between recess (41) and the unrestricted opening (47).

20. A folder as claimed in claim 15, characterized in that the fixtures (40) are provided with locating elements for locking the respective U-clamps (70) in its engaged position against withdrawal from the recesses (41, 42).

* * * * *